US011145971B1

(12) United States Patent
Cripe

(10) Patent No.: US 11,145,971 B1
(45) Date of Patent: Oct. 12, 2021

(54) POYNTING VECTOR SYNTHESIS VIA COAXIALLY ROTATING ELECTRIC AND MAGNETIC DIPOLES

(71) Applicant: Rockwell Collins, Inc., Cedar Rapids, IA (US)

(72) Inventor: David W. Cripe, Mount Vernon, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 60 days.

(21) Appl. No.: 16/570,015

(22) Filed: Sep. 13, 2019

(51) Int. Cl.
*H01Q 3/04* (2006.01)
*H01Q 9/16* (2006.01)

(52) U.S. Cl.
CPC ..... *H01Q 3/04* (2013.01); *H01Q 9/16* (2013.01)

(58) Field of Classification Search
CPC ..... H01Q 3/04; H01Q 9/16
See application file for complete search history.

(56) References Cited

U.S. PATENT DOCUMENTS 5,646,525 A * 7/1997 Gilboa ..... F41G 3/225 324/207.17
8,259,020 B1 * 9/2012 Macy ..... H01Q 19/04 343/766
10,177,452 B2 1/2019 Bickford
2019/0089059 A1 * 3/2019 Pelrine ..... H01Q 7/06
2019/0157761 A1 5/2019 Golkowski et al.

FOREIGN PATENT DOCUMENTS

CN 201369390 Y 12/2009
WO 2019084211 A1 5/2019

OTHER PUBLICATIONS

Bickford, James A. et al., "Low Frequency Mechanical Antennas Electrically Short Transmitters from Mechanically-Actuated Dielectrics", IEEE Symposium on Angennas and Propagation & USNC/URSI National Radio Science Meeting, San Diego, CA, 2017, pp. 1475-1476.
Burch, Hunter C. et al., "Experimental Generation of ELF Radio Signals Using a Rotating Magnet", IEEE Transactions on Antennas and Propagation, vol. 66, No. 11, pp. 6265-6272, Nov. 2018.

* cited by examiner

*Primary Examiner* — Seung H Lee
(74) *Attorney, Agent, or Firm* — Suiter Swantz pc llo

(57) ABSTRACT

An antenna has a rotating magnetic dipole and a rotating electric dipole having parallel axes of rotation, but orthogonal magnetic and electric vectors. The rotational frequency defines the RF carrier to create the electric and magnetic fields necessary to generate the Poynting vector in the immediate vicinity of the antenna. Because there is no energy required to maintain the fields of a permanent magnet or electret, the only power input is that overcoming mechanical friction, and eddy current and hysteretic losses in adjacent conducting structures.

13 Claims, 5 Drawing Sheets

POYNTING VECTOR SYNTHESIS VIA COAXIALLY ROTATING ELECTRIC AND MAGNETIC DIPOLES

BACKGROUND

Electrically small antennas suffer from very low efficiency and bandwidth. For applications from extreme low frequency (ELF) to low frequency (LF), where wavelengths can range from hundreds of kilometers to hundreds of meters, a full-size resonant antenna is usually too large to permit implementation on a mobile, airborne, or tactical platform.

Very low frequency (VLF) radio is resistant to jamming, fade, and nuclear ionospheric effects. Its capability to penetrate seawater gives it particular advantage for use in submarine communication, and many new applications and capabilities have been enabled by recent advances in receiver and signal processing technology. However, the wavelengths involved (10 km at 30 kHz) require massive fixed or airborne transmitter facilities to enable efficient transmission of VLF signals. Tactical and portable VLF systems must employ electrically small antennas which have compromised performance with reduced efficiency and bandwidth. Directional, uniaxial radiation would be desirable, but is generally considered impossible in an electrically small antenna.

Recent developments in the field has shown the possibility of creating electromagnetic radiation through mechanical acceleration of electrical charge, or virtual currents, avoiding the ohmic losses that limit efficiency of conventional electric-current fed antennas. The DARPA AMEBA program was established to investigate generation of ELF and VLF through mechanical motion of electret and permanent magnet dipoles.

These prior-art mechanical antennas are limited in their ability to couple their oscillating electric or magnetic fields into electromagnetic radiation, which consists of both electric and magnetic field components, establishing the radiation Poynting vector. The missing field components appear in the Fresnel zone in the transition between near field and far field, but are not generated directly by the single electrically small dipole.

SUMMARY

In one aspect, embodiments of the inventive concepts disclosed herein are directed to an antenna with a rotating magnetic dipole and a rotating electric dipole. The rotating magnetic dipole and electric dipole have parallel axes of rotation, but orthogonal magnetic and electric vectors. The rotational frequency defines the RF carrier to create the electric and magnetic fields necessary to generate the Poynting vector in the immediate vicinity of the antenna. Because there is no energy required to maintain the fields of a permanent magnet or electret, the only power input is that overcoming mechanical friction, and eddy current and hysteretic losses in adjacent conducting structures.

It is to be understood that both the foregoing general description and the following detailed description are exemplary and explanatory only and should not restrict the scope of the claims. The accompanying drawings, which are incorporated in and constitute a part of the specification, illustrate exemplary embodiments of the inventive concepts disclosed herein and together with the general description, serve to explain the principles.

BRIEF DESCRIPTION OF THE DRAWINGS

The numerous advantages of the embodiments of the inventive concepts disclosed herein may be better understood by those skilled in the art by reference to the accompanying figures in which.

DETAILED DESCRIPTION

Figure 1:
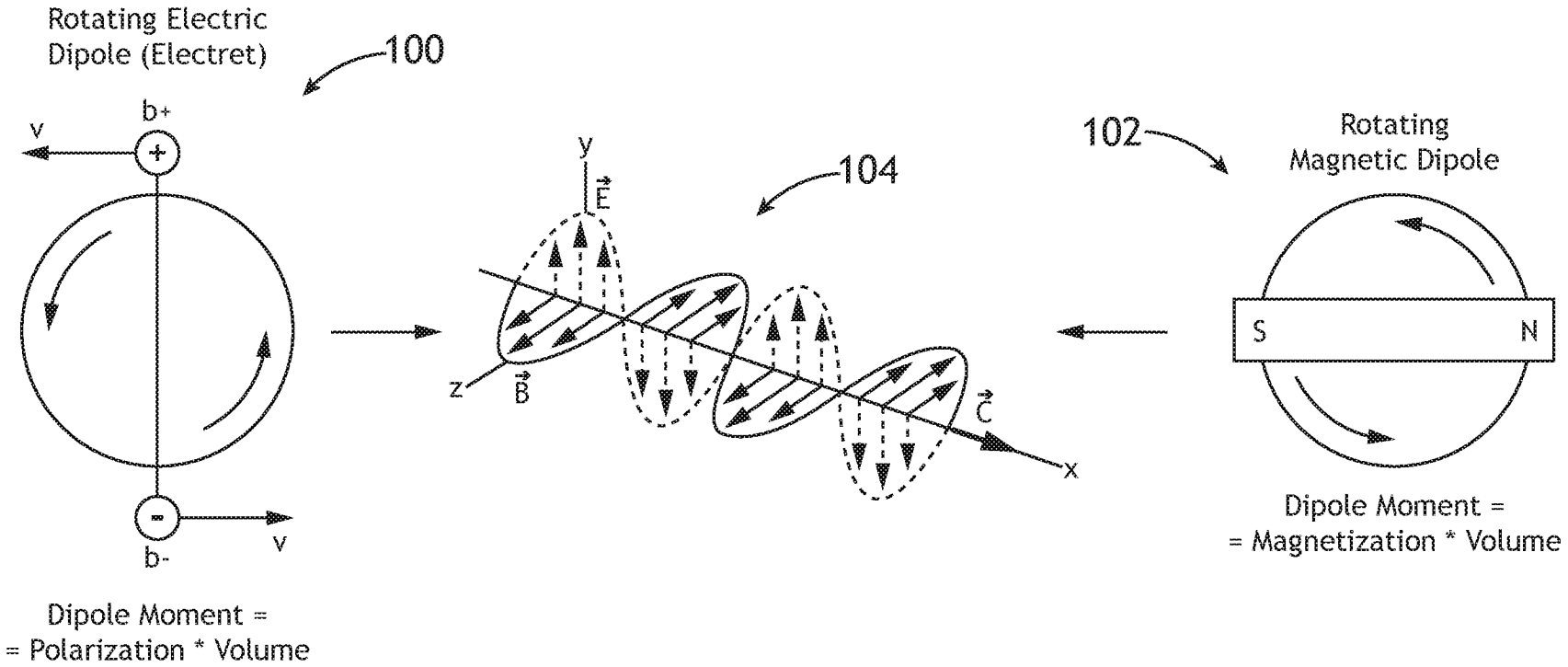
FIG. 1 shows a diagrammatic view of electric and magnetic dipoles.

Before explaining at least one embodiment of the inventive concepts disclosed herein in detail, it is to be understood that the inventive concepts are not limited in their application to the details of construction and the arrangement of the components or steps or methodologies set forth in the following description or illustrated in the drawings. In the following detailed description of embodiments of the instant inventive concepts, numerous specific details are set forth in order to provide a more thorough understanding of the inventive concepts. However, it will be apparent to one of ordinary skill in the art having the benefit of the instant disclosure that the inventive concepts disclosed herein may be practiced without these specific details. In other instances, well-known features may not be described in detail to avoid unnecessarily complicating the instant disclosure. The inventive concepts disclosed herein are capable of other embodiments or of being practiced or carried out in various ways. Also, it is to be understood that the phraseology and terminology employed herein is for the purpose of description and should not be regarded as limiting.

As used herein a letter following a reference numeral is intended to reference an embodiment of the feature or element that may be similar, but not necessarily identical, to a previously described element or feature bearing the same reference numeral (e.g., 1, 1*a*, 1*b*). Such shorthand notations are used for purposes of convenience only, and should not be construed to limit the inventive concepts disclosed herein in any way unless expressly stated to the contrary.

Further, unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of embodiments of the instant inventive concepts. This is done merely for convenience and to give a general sense of the inventive concepts, and "a" and "an" are intended to include one or at least one and the singular also includes the plural unless it is obvious that it is meant otherwise.

Finally, as used herein any reference to "one embodiment," or "some embodiments" means that a particular element, feature, structure, or characteristic described in connection with the embodiment is included in at least one embodiment of the inventive concepts disclosed herein. The appearances of the phrase "in some embodiments" in various places in the specification are not necessarily all referring to the same embodiment, and embodiments of the inventive concepts disclosed may include one or more of the features expressly described or inherently present herein, or any combination of sub-combination of two or more such features, along with any other features which may not necessarily be expressly described or inherently present in the instant disclosure.

Broadly, embodiments of the inventive concepts disclosed herein are directed to an antenna with a rotating magnetic dipole and a rotating electric dipole. The rotating magnetic dipole and electric dipole have parallel axes of rotation, but orthogonal magnetic and electric vectors. The rotational frequency defines the RF carrier to create the electric and magnetic fields necessary to generate the Poynting vector in the immediate vicinity of the antenna. Because there is no energy required to maintain the fields of a permanent magnet or electret, the only power input is that overcoming mechanical friction, and eddy current and hysteretic losses in adjacent conducting structures.

Referring to FIG. 1, a diagrammatic view of electric and magnetic dipoles 100, 102 is shown. A Poynting vector 104 being the cross-product of an electric field vectors and magnetic field vectors, a Poynting vector 104 having desirable very low frequency (VLF) properties in the immediate vicinity of a radiating element is produced via a rotating electric dipole 100 (an electret, either naturally occurring or manufactured) and a rotating magnetic dipole 102. The electric dipole 100 and magnetic dipole 102 rotate about a common axis, and with a rotational frequency equal to the RF carrier frequency.

Figure 2:
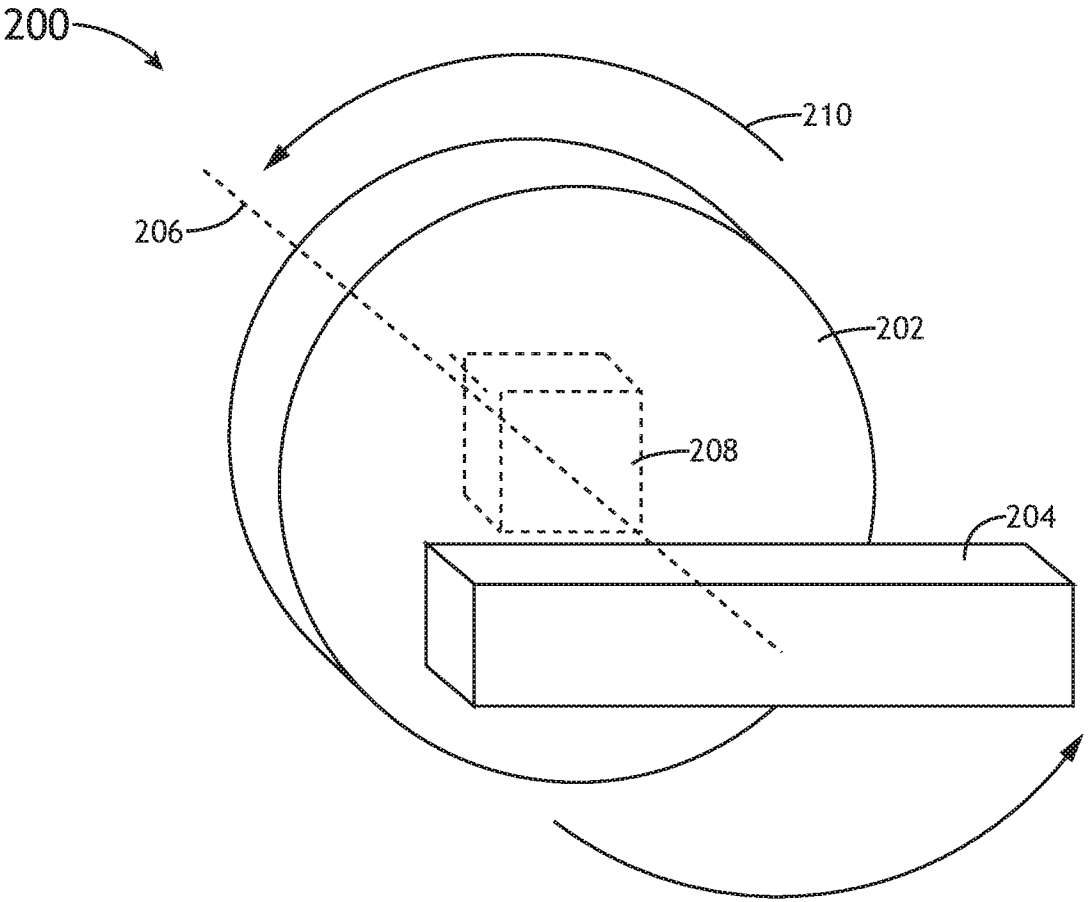
FIG. 2 shows a perspective view of an exemplary embodiment of a rotating antenna element.

Referring to FIG. 2, a perspective view of an exemplary embodiment of a rotating antenna element 200 is shown. The antenna element 200 comprises an electric dipole 202 and a magnetic dipole 204 either affixed to each other or otherwise configured to rotate about a common axis 206. A motor 208 is disposed to rotate the electric dipole 202 and magnetic dipole 204 with a rotational frequency 210 corresponding to a desired carrier wave frequency. Signals applied to the antenna element 200 radiate in a frequency range defined by the rotational frequency 210; generally within the VLF range. The electric dipole 202 and magnetic dipole 204 may be separated by small distance as compared to the carrier frequency.

In at least one embodiment, the antenna element 200 generates a circularly polarized lobe of radiation emerging normal to the plane of rotation. Amplitude modulation of the generated signal is produced indirectly through spatial modulation of the direction of the radiation lobe. By adjusting the rotational angle between the electric dipole 202 and magnetic dipole 204, the direction of this radiation lobe may be continuously controlled between positive and negative values in the direction normal to the plane of rotation. The amplitude of the generated signal may be proportional to the sine of the angle between the electric dipole 202 and magnetic dipole 204.

In at least one embodiment, phase and frequency modulation may be produced by controlling the phase and frequency of the rotation of the electric dipole 202 and magnetic dipole 204.

Figure 3:
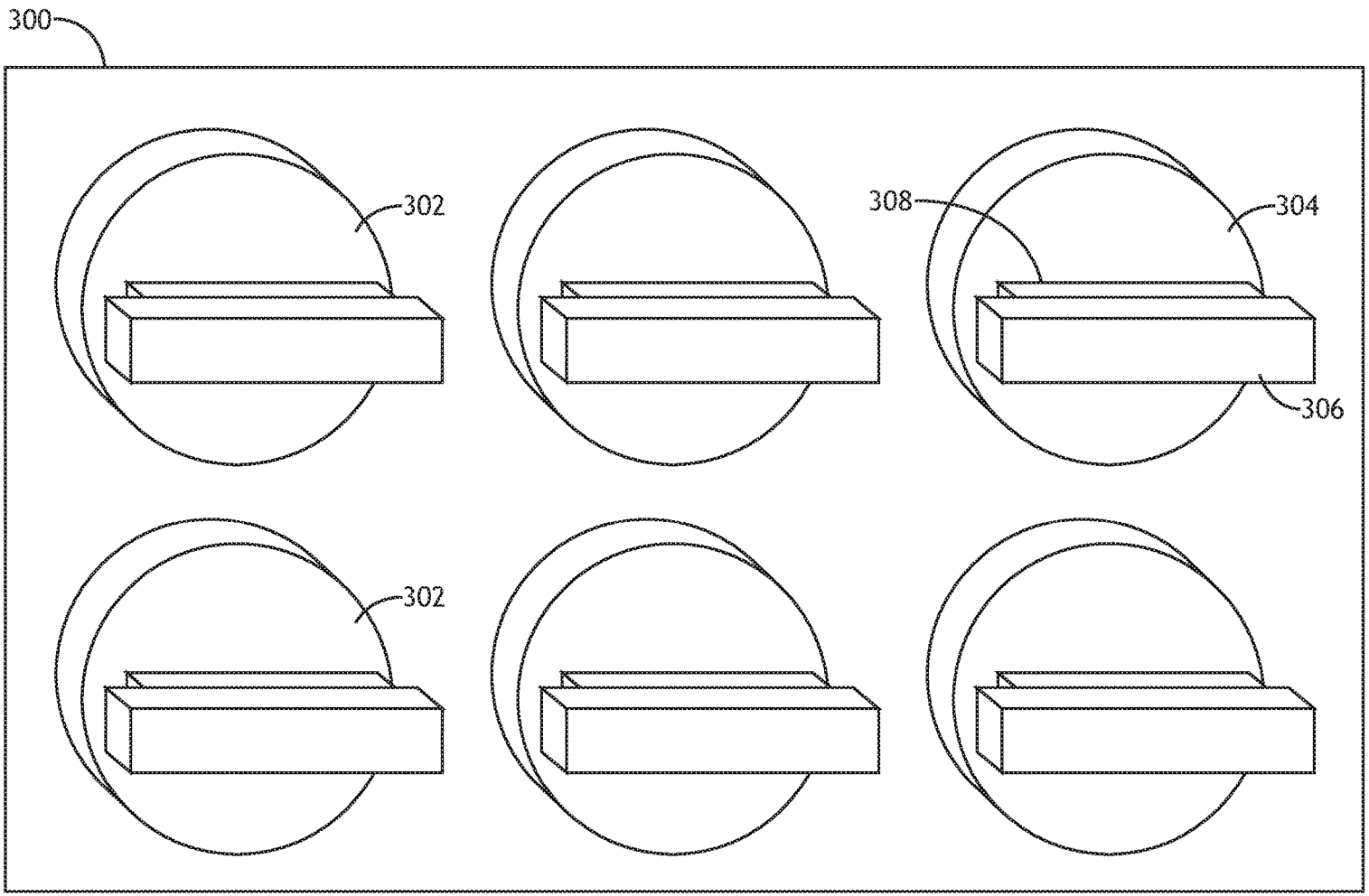
FIG. 3 shows a perspective view of an exemplary embodiment of an array of rotating antenna elements.

Referring to FIG. 3, a perspective view of an exemplary embodiment of an array of rotating antenna elements is shown. The array 300 comprises a plurality of antenna elements 302, each comprising an electric dipole 304 and a magnetic dipole 306 either affixed to each other via a rigid connecting element 308 or otherwise configured to rotate about a common axis. Motor are disposed to rotate each antenna element 302 with a rotational frequency corresponding to a desired carrier wave frequency. Signals applied to the antenna element 302 radiate in a frequency range defined by the rotational frequency; generally within the VLF range.

In at least one embodiment, neighboring antenna elements 302 may receive signals configured create constructive or destructive interference with other neighboring antenna elements 302 via coupling to enhance the directionality of the resulting signal.

In at least one embodiment, individual antenna elements 302 within the array 300 may be rotated at different rotational frequencies.

Figure 4:
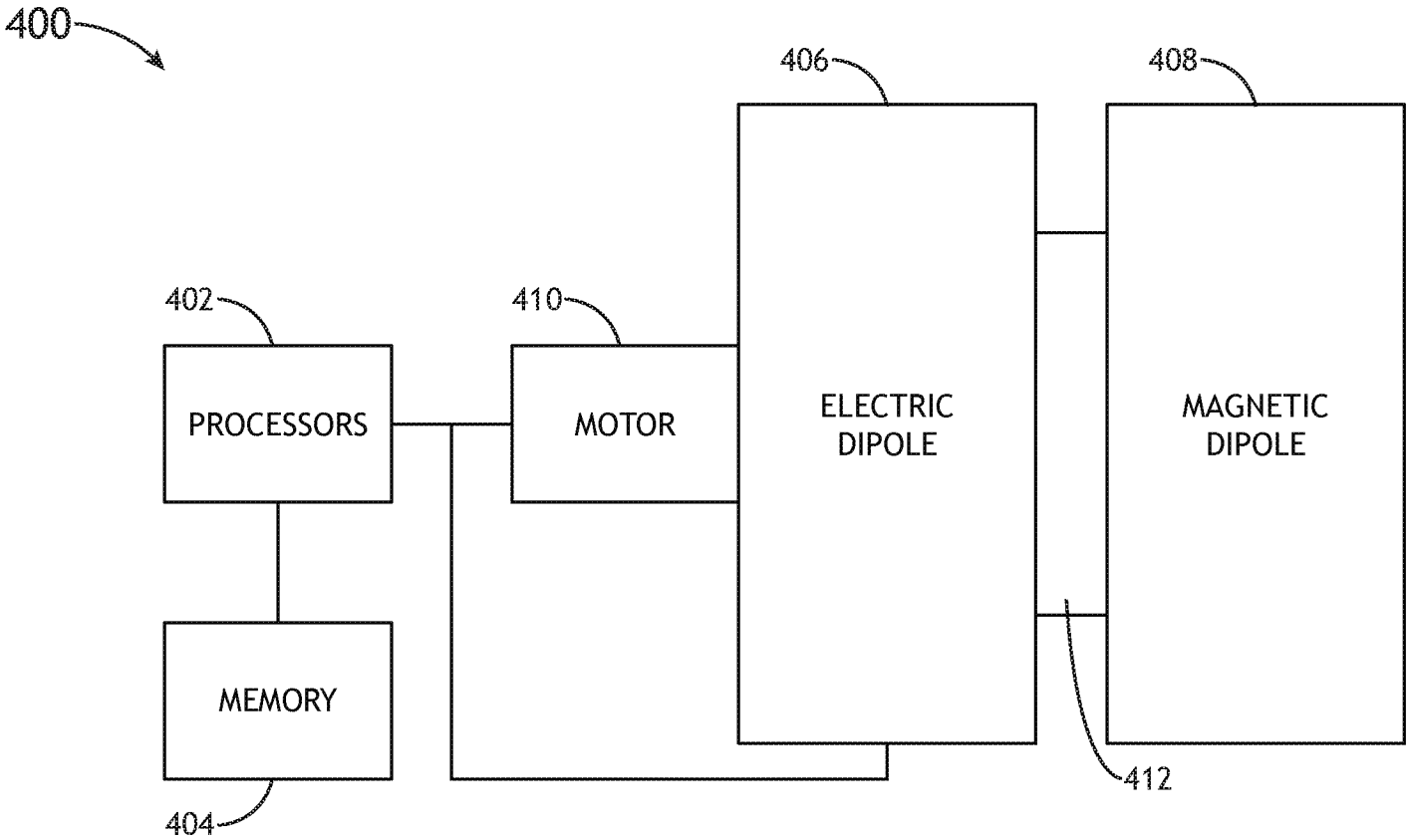
FIG. 4 shows a block diagram of a system including exemplary embodiments of a rotating antenna element.

Referring to FIG. 4, a block diagram of a system 400 including exemplary embodiments of a rotating antenna element is shown. The system 400 includes a processor 402, memory 404 in data communication with the processor 402, and an antenna element comprising an electric dipole 406 and magnetic dipole 408 in data communication with the processor 402. A motor 410 in electronic communication with the processor 402 is configured to rotate the electric dipole 406 and magnetic dipole 408 about a common axis. In at least one embodiment, the electric dipole 406 and magnetic dipole 408 are connected together by a rigid connecting element 412.

In at least one embodiment, the processor 402 applies a signal to the motor 410 based on a desired carrier frequency to produce a rotational frequency in the antenna element; in some embodiments, the rotational frequency corresponds to a VLF carrier. The processor 402 then applies a signal to the antenna element to transmit the signal in the VLF range.

Figure 5:
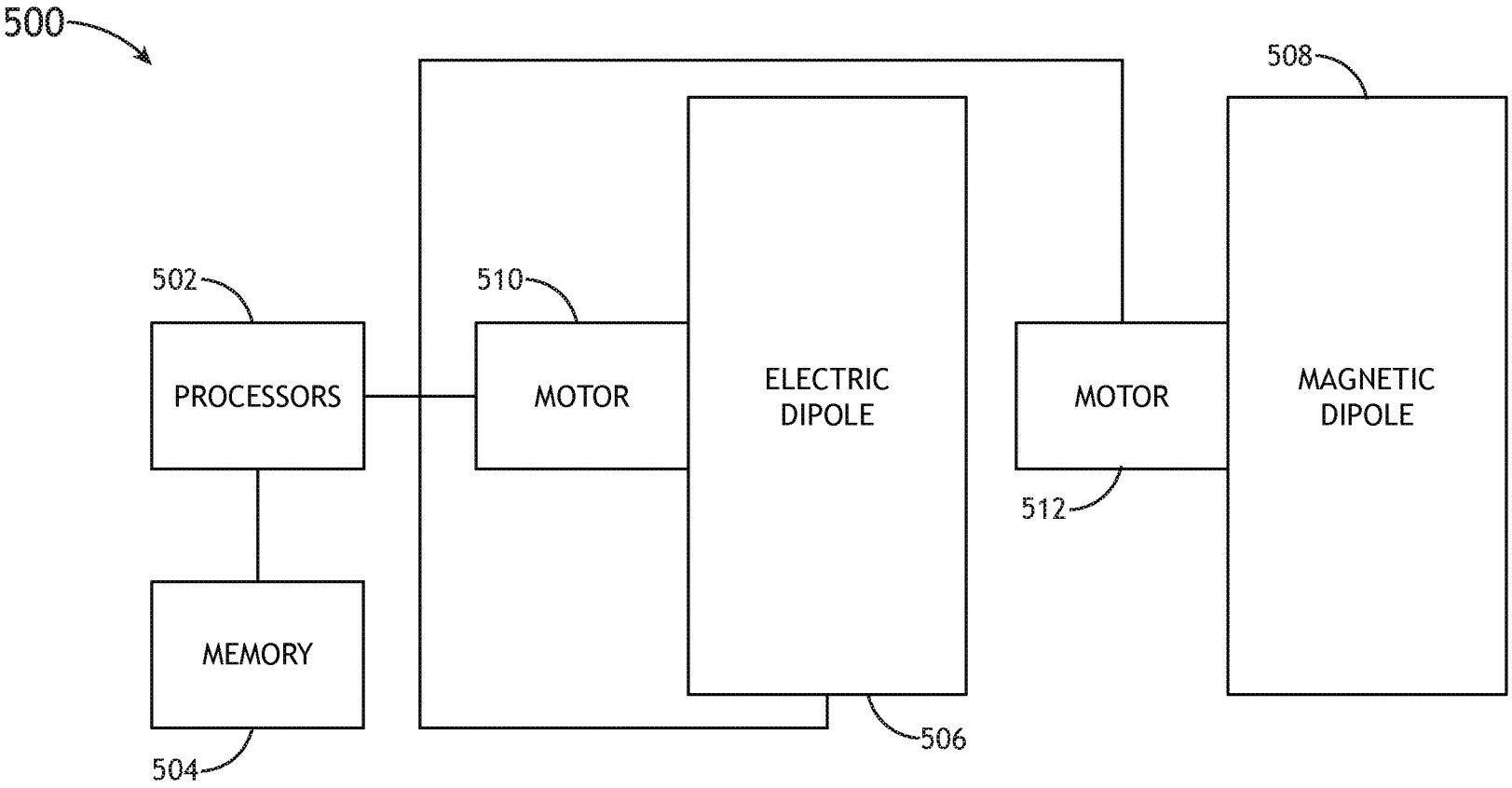
FIG. 5 shows a block diagram of a system including exemplary embodiments of a rotating antenna element.

Referring to FIG. 5, a block diagram of a system 500 including exemplary embodiments of a rotating antenna element is shown. The system 500 includes a processor 502, memory 504 in data communication with the processor 502, and an antenna element comprising an electric dipole 506 and magnetic dipole 508 in data communication with the processor 502. A motor 510 in electronic communication with the processor 502 is configured to rotate the electric dipole 506 and magnetic dipole 508 about a common axis. In at least one embodiment, the electric dipole 506 and magnetic dipole 508 are connected together by a rigid connecting element 512.

In at least one embodiment, the processor 502 applies a signal to the motor 510 based on a desired carrier frequency to produce a rotational frequency in the antenna element; in some embodiments, the rotational frequency corresponds to a VLF carrier. The processor 502 then applies a signal to the antenna element to transmit the signal in the VLF range.

Embodiments of the present disclosure may produce smaller, more energy efficient antennas requiring a source of electromagnetic energy at sub-30 kHz frequencies than alternative antennas. At frequencies near VLF or below, the mechanical requirements of rotating elements are relaxed. Unlike conventional electrically small antennas that generally either generate primarily an electric field, or magnetic field, and rely upon Poynting vector formation to occur in the Fresnel region, an antenna according to the present disclosure directly generates the Poynting vector in close proximity to the antenna. An antenna according to the present disclosure creates directional, uniaxial radiation.

It is believed that the inventive concepts disclosed herein and many of their attendant advantages will be understood by the foregoing description of embodiments of the inventive concepts disclosed, and it will be apparent that various changes may be made in the form, construction, and arrangement of the components thereof without departing from the broad scope of the inventive concepts disclosed herein or without sacrificing all of their material advantages; and individual features from various embodiments may be combined to arrive at other embodiments. The form herein before described being merely an explanatory embodiment thereof, it is the intention of the following claims to encompass and include such changes. Furthermore, any of the features disclosed in relation to any of the individual embodiments may be incorporated into any other embodiment.

What is claimed is:

1. An antenna apparatus comprising:
an electric dipole;
a magnetic dipole; and
a motor configured to rotate the electric dipole and magnetic dipole about parallel axes,
wherein:
the electric dipole and magnetic dipole are disposed and oriented with orthogonal magnetic vectors and electric vectors; and
the electric dipole and magnetic dipole are disposed and oriented to produce a Poynting vector before a Fresnel region defined by the antenna.

2. The antenna apparatus of claim 1, further comprising a rigid connecting element connecting the electric dipole to the magnetic dipole.

3. The antenna apparatus of claim 1, further comprising an array of antennas, each comprising an electric dipole, a magnetic dipole, and a motor configured to rotate the corresponding electric dipole and magnetic dipole about parallel axes, wherein the antennas in the array are configured to produce a directional signal via coupling.

4. The antenna apparatus of claim 1, wherein:
the motor comprises an electric dipole motor disposed on the electric dipole;
the antenna further comprises a magnetic dipole motor disposed in the magnetic dipole; and
the electric dipole motor and magnetic dipole motor are configured to rotate coaxially.

5. The antenna apparatus of claim 1, wherein the electric dipole and magnetic dipole are separated by a distance less than a wavelength of the carrier frequency.

6. The antenna apparatus of claim 5, wherein the carrier frequency is between 3 kHz and 30 kHz.

7. A communication system comprising:
an antenna comprising:
an electric dipole;
a magnetic dipole; and
a motor configured to rotate the electric dipole and magnetic dipole about parallel axes; and
at least one processor in data communication with a memory storing processor executable code for configuring the at least one processor to:
apply a signal to the motor to induce a rotation at a defined carrier frequency.

8. The system of claim 7, wherein the electric dipole and magnetic dipole are disposed and oriented with orthogonal magnetic vectors and electric vectors.

9. The system of claim 7, wherein the electric dipole and magnetic dipole are disposed and oriented to produce a Poynting vector before a Fresnel region defined by the antenna.

10. The system of claim 7, further comprising a rigid connecting element connecting the electric dipole to the magnetic dipole.

11. The system of claim 7, wherein:
the system comprises an array of antennas, each comprising an electric dipole, a magnetic dipole, and a motor configured to rotate the corresponding electric dipole and magnetic dipole about parallel axes; and
the antennas in the array are configured to produce a directional signal via coupling.

12. The system of claim 7, wherein:
the motor comprises an electric dipole motor disposed on the electric dipole;
the antenna further comprises a magnetic dipole motor disposed in the magnetic dipole; and
the electric dipole motor and magnetic dipole motor are configured to rotate coaxially.

13. The system of claim 7, wherein the electric dipole and magnetic dipole are separated by a distance less than a wavelength of the carrier frequency.

* * * * *